US005342006A

United States Patent [19]

Tice: Mary

[11] Patent Number: 5,342,006

[45] Date of Patent: Aug. 30, 1994

[54] ARM REST

[76] Inventor: Tice: Mary, R.R. #1, Zephyr, Ontario, Canada, L0E 1T0

[21] Appl. No.: 5,778

[22] Filed: Jan. 19, 1993

[51] Int. Cl.[5] ..... B43L 15/00

[52] U.S. Cl. ..... 248/118; 248/918

[58] Field of Search ..... 248/118, 118.1, 118.3, 248/118.5, 918, 214, 302, 225.31; 400/715; 132/73; 108/44, 46, 152

[56] References Cited

U.S. PATENT DOCUMENTS

| | | | |
|---|---|---|---|
| Re. 23,339 | 2/1951 | Ducey | 248/225.31 X |
| 1,967,898 | 7/1934 | Nilson | 248/214 |
| 2,477,898 | 8/1949 | Rehman et al. | 248/118 |
| 3,181,485 | 5/1965 | Dotson et al. | 108/152 X |
| 3,212,742 | 10/1965 | Pavoni | 248/302 X |
| 4,592,584 | 6/1986 | White, Jr. | 248/118 X |
| 5,072,905 | 12/1991 | Hyatt | 248/918 X |
| 5,119,742 | 6/1992 | Simmie | 248/214 X |

FOREIGN PATENT DOCUMENTS

| | | | |
|---|---|---|---|
| 2113540 | 8/1983 | United Kingdom | 108/46 |

*Primary Examiner*—Karen J. Chotkowski

[57] ABSTRACT

A desk fittable arm rest which is used for alleviating bursitis, upper back and neck pain is designed to fit to a desk top at a work station. The arm rest comprises a rigid support frame, a cushion member atop the support frame and a cantilever attached from beneath and extending to a position forwardly of the frame. The frame has a forward overhang region spaced above the cantilever member to define a desk top fitting gap between the frame and the cantilever member. Through the use of the cantilever, the arm rest does not require anything in the way of a permanent attachment to affix it to the desk top and can be moved from one desk top to another.

7 Claims, 3 Drawing Sheets

FIG. 2.
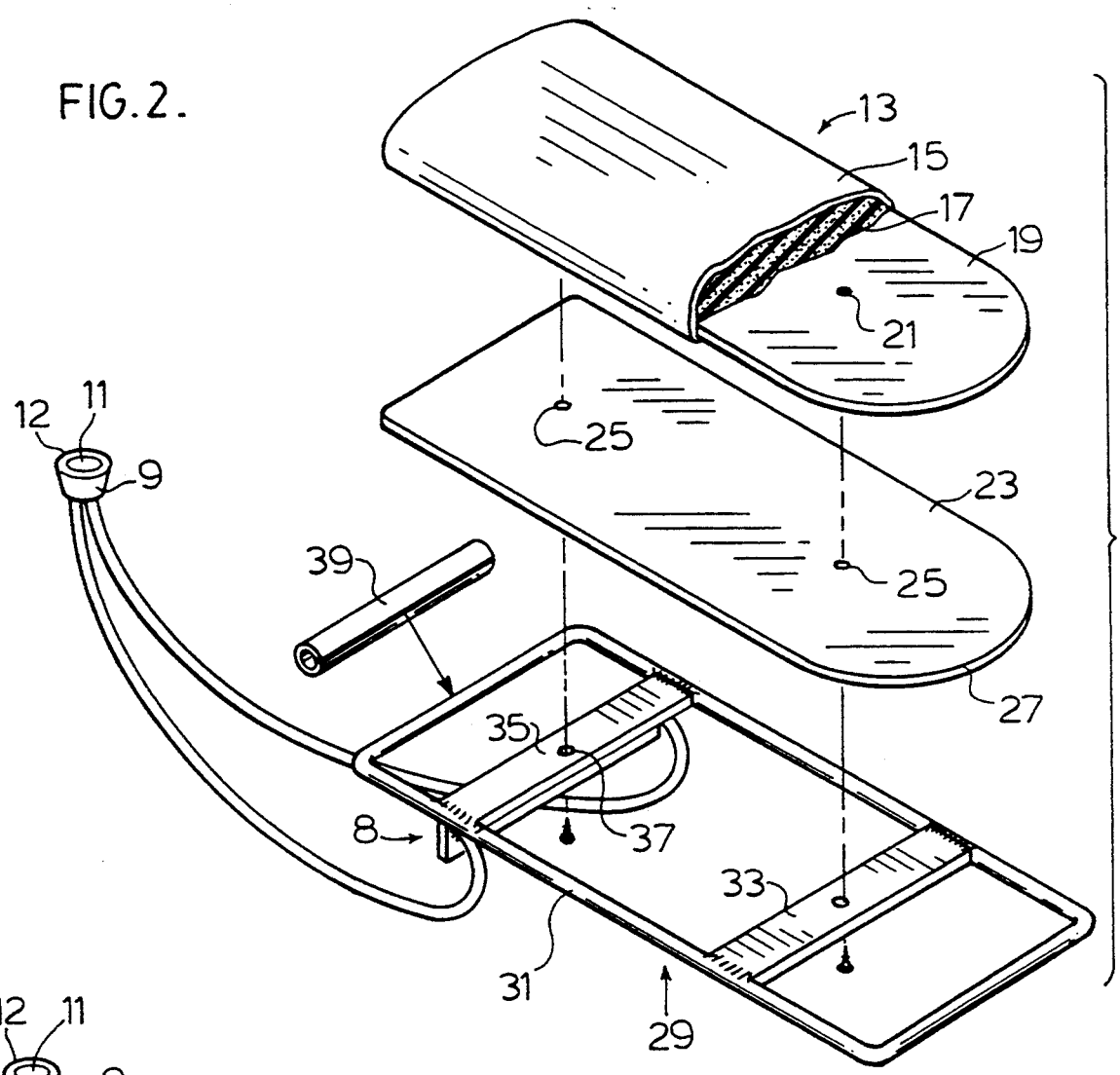
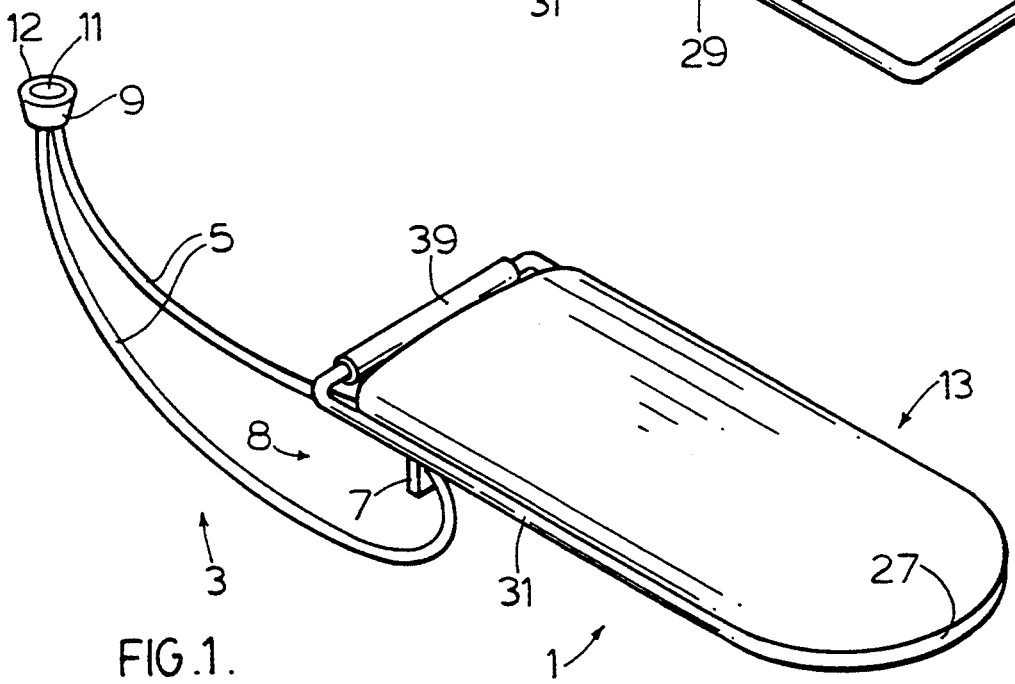
FIG. 1.

FIG. 5.
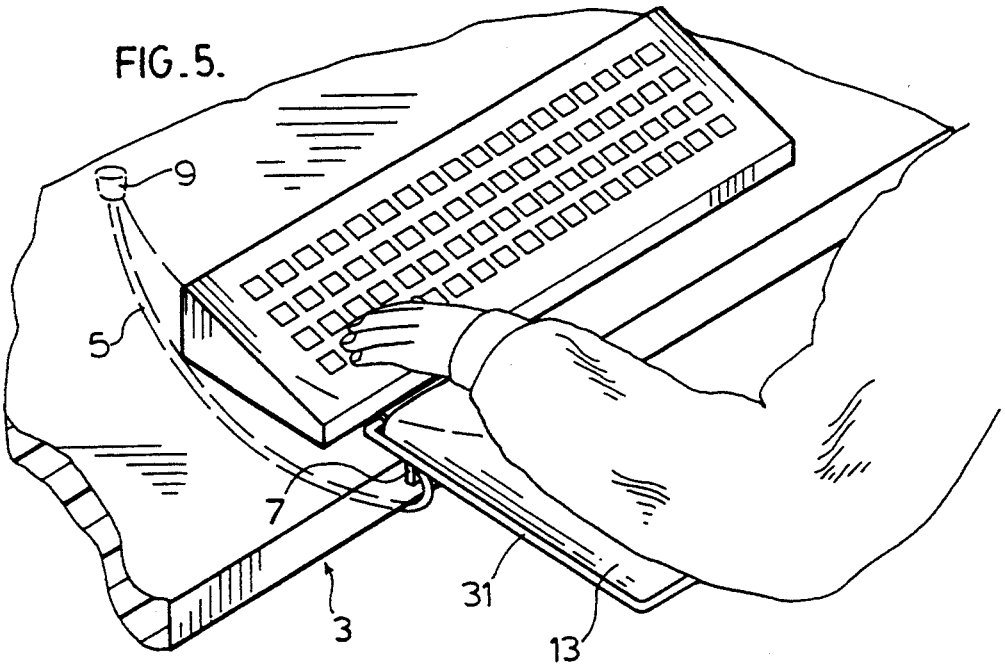
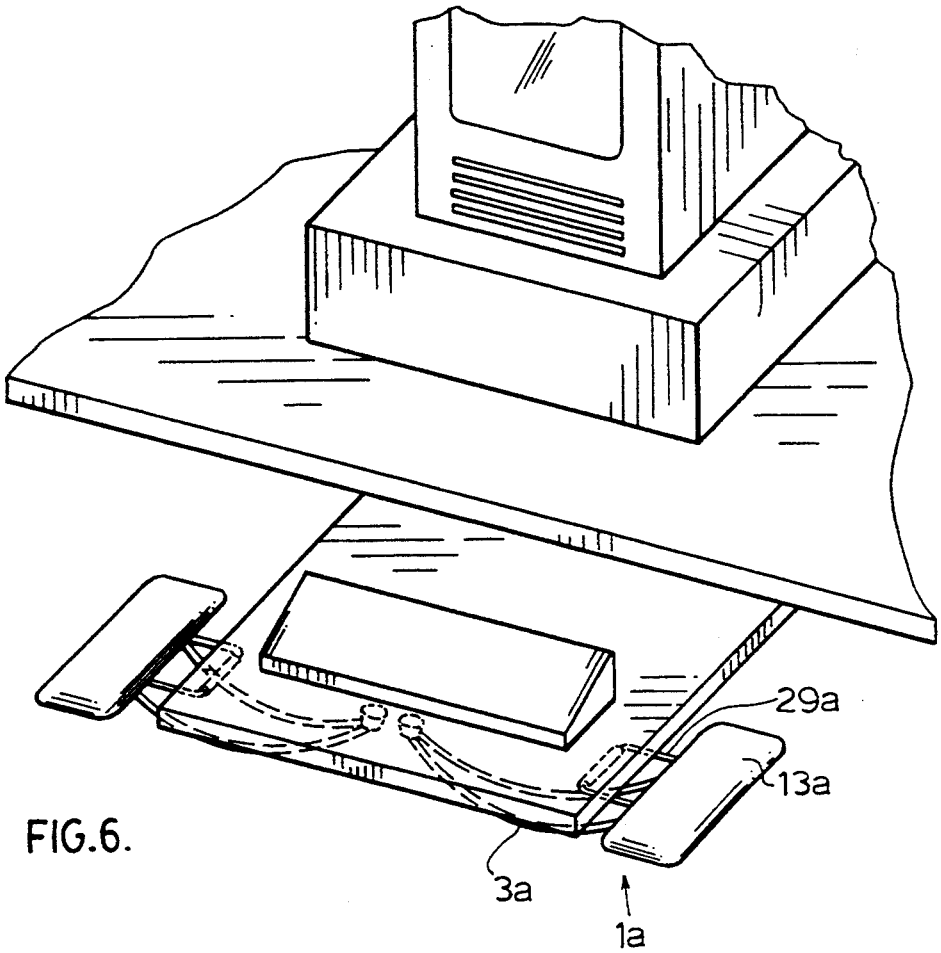
FIG. 6.

ARM REST

FIELD OF THE INVENTION

The present invention relates to an arm rest which is removably securable to a desk top.

BACKGROUND OF THE INVENTION

More and more medical problems are being encountered by people who work at desk top computers, typewriters, etc. These medical problems include bursitis as well as neck and upper back strain. Surprisingly enough, the reason for the problems is the positioning of ones wrist and elbow on a hard desk top surface which is the typical arm positioning required to operate a mouse for a computer or even the keyboard for the computer. However, at the same time it is not practical to build a desk top with a fully cushioned surface or to in some other way, permanently alter the desk top to more comfortably position ones wrist and/or elbow.

SUMMARY OF THE INVENTION

The present invention provides an arm rest which removably attaches to a desk top. The arm rest is used to comfortably support the forearm of a person using the arm rest and alleviates the strain on ones wrist and elbow which would otherwise be positioned on the desk top.

The arm rest of the present invention comprises a rigid support frame, a cushion member atop the frame and a cantilever attached from beneath and extending to a position forwardly of the frame. The frame has a forward overhand region spaced above the cantilever member to define a desk top fitting gap between the frame and the cantilever. Through the use of the cantilever, the arm rest does not require anything in the way of permanent attachments to affix it to the desk top but rather is simply slipped over the desk top without the use of tools whatsoever.

As a result of the removable or releasable fitting of the arm rest to the desk top, it is not dedicated to a particular location and as such can be moved from desk to desk as desired.

BRIEF DESCRIPTION OF THE DRAWINGS

The above as well as other advantages and features of the present invention will be described in greater detail according to the preferred embodiments of the present invention in which;

FIG. 1 is a perspective view of a desk top arm rest according to a preferred embodiment of the present invention;

FIG. 2 is an exploded perspective view of the arm rest of FIG. 1;

FIG. 5 shows the arm rest of FIG. 3 used for operating a computer keyboard;

FIG. 6 shows pair of arm rests modified slightly from the arm rest of FIG. 1 in accordance with a further preferred embodiment of the present invention.

Figure 3:
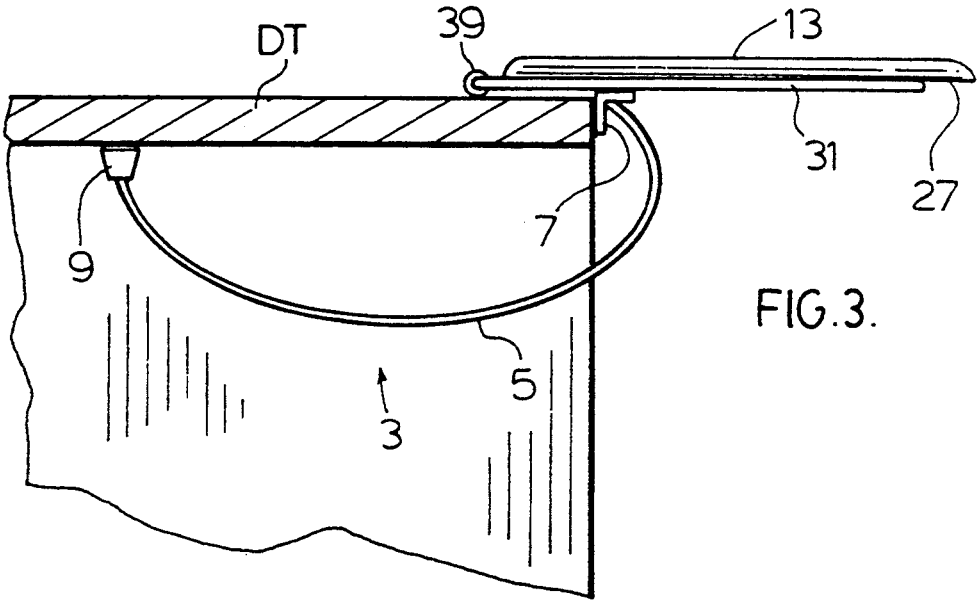
FIG. 3 is a side view of the arm rest of FIG. 2 when fitted to a desk top.

DETAILED DESCRIPTION ACCORDING TO THE PREFERRED EMBODIMENTS OF THE PRESENT INVENTION

FIG. 1 shows a portable arm rest generally indicated at 1. This arm rest is removably fittable with substantially any desk top where the desk top has some type of an overhang. See for example, FIGS. 3, 4 and 5.

The arm rest itself has a cantilever generally indicated at 3 which comprises a pair of curved bars 5, interconnected at their rearward ends through an L shaped bracket 7 and at their forward ends within a rubber desk grip 9. Note that the desk grip 9 has a hollowed center 11 resulting in a peripheral gripping edge 12 on the grip member 9.

As can be seen in the drawings, the cantilever bars or rods 5 diverge rearwardly from one another along the length of the cantilever. This enhances the balance of the cantilever where it connects to the rest of the arm rest. On the other hand, the converging of the cantilever bars at the forward end of the cantilever maximizes or concentrates its gripping ability beneath the desk top as will be described later in detail.

The cantilever bracket 7 secures to a rigid frame generally indicated at 29. This frame is formed by a U-shaped outer frame portion 31 with a pair of cross-bars 33 and 35 secured by welding or the like across the U-shaped frame. Flat metallic plate 23 sits down within the outer frame portion 31 directly atop cross-bars 33 and 35 and is secured again by welding or the like to the rigid support frame 29.

An upper cushioned support generally indicated at 13 includes a lower rigid base 19 which in the preferred embodiment is made of plywood. A high density foam layer 18 seats directly atop the rigid base 19 and an outer cover 15 is provided over the foam. In the preferred embodiment, the foam is about ½" in thickness and cover 15 is preferably made from an upholstery fabric or the like.

Again, in the preferred embodiment a pair of T-nuts 21 are fitted directly into the base 19 of pad 13. The pad is secured to plate 23 by means of threaded screws as shown which fit up through a pair of openings 25 in the plate and thread into the T-nuts in the base of the pad.

For storage and shipping purposes, the cantilever 3 with its mounting bracket 7 is formed separately of the frame 29. The forward cross-bar of the frame is fitted with downwardly extending bolts 37 secured as for example, by welding, against rotation in the cross-bar. Bracket 7 of the cantilever has a pair of bolt receiving openings in its horizontal leg to allow the bracket to be fitted to the cross-bar by the bolts 37 and a pair of threaded nuts are provided to secure the cantilever bracket on the cross-bar bolts.

When the cantilever is secured to the frame as shown for example in FIG. 1, a gap 8 is defined between the cantilever and the forward region of the frame which overhangs the cantilever.

In order to fit the arm rest to a desk top, the cantilever is positioned beneath the desk top, the forward part of the frame is located over the desk top and the arm rest is then simply pushed onto the desk top where it fits in the gap 8 between the cantilever and the forward overhang region of the frame. Note that the outer frame portion 31 is covered at its front end with a soft preferably rubber or rubber-like wrapper 39. This wrapper has a two fold function. Firstly, it protects the desk top against marring and scratching by eliminating direct contact of the rigid material of the frame with the desk top. Secondly, the high co-efficient of friction in the wrapper provides a very effective grip which resists sliding on the desk top and provides a very positive location for the arm rest.

The cap 9 on the forward end of the cantilever also has a soft preferably rubber or rubber-like construction. It, like the wrapper 39, again provides a very positive grip to the underside of the desk top The grip of the cap is further enhanced through the provision of depression 11 where the peripheral edge 12 of the cap produces a very highly concentrated and positive contact with the underside of the desk top.

Figure 4:
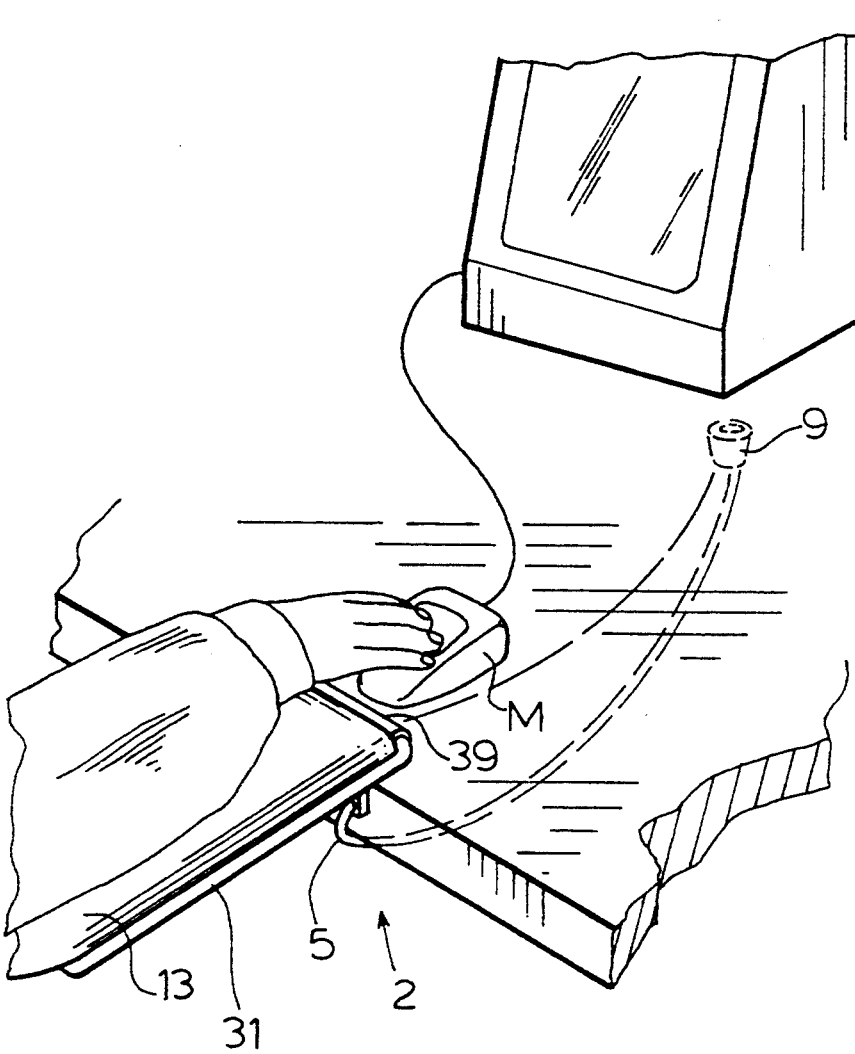
FIG. 4 shows the arm rest of FIG. 3 used for operating a computer mouse.

As best seen in FIG. 3 of the drawings, the vertical leg of the L-shaped bracket 7 provides a very effective stop and determines maximum forward positioning of the arm rest on the desk top DT. The frame wrapper 39 and cap 9 resist any rearward movement of the arm rest particularly when it is weighted down by the arm of a user as shown in FIGS. 4 and 5 of the drawings. It is to be noted in FIG. 3 that even when cantilever bracket 7 is pushed fully up against the front edge of the desk top, a substantial amount of the arm rest hangs in open space outwardly beyond the desk top.

FIG. 4 shows a computer operator with his or her forearm seated on the arm rest for hand manipulation of a mouse M of a computer screen S. The forearm muscle of the computer operator sits directly atop the elevated cushioned surface 13 of the arm rest and raises the operators arm slightly above desk top level so there is little, if any weight taken by the hand and wrist of the operator. This also substantially frees up the operator's hand and positions it properly for easy movement of the mouse.

The same forearm support is provided by the arm rest when working the keyboard of FIG. 5, where once again, the hand is somewhat elevated from the desk top for a very effective positioning of the hand relative to the keyboard panel.

From a manufacturing standpoint, the arm rest is made from inexpensive easy to assemble components. For example, the cantilever bars 5 like the outer frame portion 31 are preferably made from ¼" bar stock. The remaining construction is also made from relatively inexpensive off the shelf components.

Although the cantilever arms are made from a rigid material, the cantilever itself because of its configuration is resiliently bendable or deflectable along its length. This adapts the arm rest to fit to different desk top thicknesses because once a load is placed on the arm rest, the cantilever deflects to grip the desk top from beneath as earlier described. Furthermore, the resilient nature of the cantilever allows some up and down movement at the free end of the arm rest which hangs outwardly away from the desk top. This produces a comfortable shock absorber effect over the length of the arm rest.

As best seen in FIG. 3 of the drawings, for comfort purposes, the upper pad portion 13 of the arm rest includes a rounded forward end 27 which hangs outwardly beyond the rigid frame portion 31 of the arm rest. This ensures that the operators arm as shown in FIG. 4 of the drawings does not come into contact with any rigid surfaces on the arm rest. Furthermore, the rounding of the edge 27 reduces interference with the operators arm as it moves on the arm rest.

In all of the embodiments described above, the cushion is fitted extending along the length of the arm rest. This set up is used for a desk top which is strictly transverse to the body positioning of the operator. FIG. 6 of the drawings on the other hand shows an arm rest generally indicated at la having a cantilever 3*a*, a rigid frame 29*a* and an upper pad 13*a*. In this particular case, the upper pad 13*a* rather than running along the length of the frame is turned at right angles to the frame. This design is applicable for desk tops having work surfaces at right angles to one another and where the arm rest can be secured to one of the work surfaces with the mouse or computer terminal on the other work surface.

In terms of attachment and use of arm rest 1*a*, it is identical to arm rest 1 as earlier described.

As will be appreciated from the description above, a particularly advantageous feature of the arm rest of the present invention is that it can quickly and easily be moved from one desk top another and does not require either any permanent attachments nor any tools to locate the arm rest in its working position.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A desk fittable arm rest comprising a support frame and an elongated cushion on an upper surface of said frame, said frame having an undersurface provided with a desk edge stop located part way along said frame whereby part of said frame and part of said cushion from a desk top engaging overhang portion above and forwardly of said desk edge stop, and a cantilever which is attached to said frame at said desk edge stop, said cantilever extending below and forwardly of said frame to define a desk top fitting gap between said cantilever and said frame and said cantilever having a length and a curvature which makes said cantilever sufficiently flexible to provide up and down shock absorber movement of said arm rest when under load.

2. An arm rest as claimed in claim 1, wherein said support frame comprises a first frame portion formed by a U-shaped outer frame member and a pair of cross bars across said outer frame member, and a second frame portion comprising a solid plate secured atop said cross bars and bordered by said outer frame member of said first frame portion, said plate providing a seat for said cushion member on said armrest.

3. An arm rest as claimed in claim 2, wherein said cushion member comprises a solid base secured to said plate, a form layer supported by said base and a protective cover over said foam layer.

4. A desk fittable arm rest as claimed in claim 1, wherein said cantilever curvature is arched downwardly, rearwardly and then extends forwardly upwardly from said desk edge stop.

5. A desk fittable armrest as claimed in claim 1, wherein said desk edge stop with said cantilever attached thereto is releasably secured to said frame.

6. A desk fittable arm rest as claimed in claim 1, wherein said frame includes a front end transverse frame member disposed adjacent a forward edge of the cushion, said transverse frame member forming part of said overhand portion and being covered by a rubber wrapper, said rubber wrapper providing a desk top contact for said arm rest.

7. A desk fittable arm rest as claimed in claim 6, wherein said cantilever comprises a pair of cantilever bars secured separated from one another to said desk edge stop and which coverage forwardly and meet with one another at a softened rubber grip cap located at maximum forward reach of said cantilever.

* * * * *